United States Patent [19]

Volke

[11] 4,338,585

[45] Jul. 6, 1982

[54] SOLENOID HAVING A HINGED ARMATURE

[75] Inventor: Hans-Werner Volke, Salzkotten, Fed. Rep. of Germany

[73] Assignee: Nixdorf Computer AG, Paderborn, Fed. Rep. of Germany

[21] Appl. No.: 199,755

[22] Filed: Oct. 23, 1980

[30] Foreign Application Priority Data

Oct. 26, 1979 [DE] Fed. Rep. of Germany ..... 2943440

[51] Int. Cl.[3] ..... H01F 7/14

[52] U.S. Cl. ..... 335/274; 335/276; 335/275

[58] Field of Search ..... 335/275, 276, 274, 270, 335/128, 181, 219, 272

[56] References Cited

U.S. PATENT DOCUMENTS 995,255 6/1911 Kaisling ..... 335/276

OTHER PUBLICATIONS

Printing Hammer Drive, F. Hilpert, IBM Technical Disclosure Bulletin, vol. 11, No. 7, Dec. 1968, p. 815.

*Primary Examiner*—L. T. Hix
*Assistant Examiner*—S. D. Schreyer
*Attorney, Agent, or Firm*—Krass, Young & Schivley

[57] ABSTRACT

Hinged armature magnet for matrix printer head with a hinged armature (24), which near its one end is fixed one end of the magnet yoke (12) by means of a mounting part (48) so as to be able to swing out against spring force, wherein the hinged armature (24) and the mounting part (48) rest in common against a substantially cylindrical pin (80) which with its cylindrical axis is arranged substantially parallel to the pivoting axis of the hinged armature (24) near the corner edge of the magnet yoke (12). The pin (80) with a recess (84) can be supported in a cutout (82) in the magnet yoke (12). By the rolling motion of the hinged armature (24) on the cylindrical surface of the pin (80) during the starting motion of the hinged armature, the lever arm enlarges between the momentary position of the pivoting axis of the hinged armature and the supporting tongue (76) of the mounting part (48) transmitting the spring force, in which way a progressive spring action occurs.

5 Claims, 3 Drawing Figures

SOLENOID HAVING A HINGED ARMATURE

DESCRIPTION

1. Technical Field

The invention relates to a hinged or swinging armature magnet for a matrix printer head, with a hinged armature which on its free end carries a printing needle and is fixed on its other end by means of a mounting part on one shank of the magnet yoke so as to be swingable against spring force, wherewith the swinging path is delimited by a stop.

2. Description of Prior Art

A hinged armature magnet is generally known, for example, from German Offenlegungschrift No. 2,717,077. In the known embodiment the hinged armature, by its fixed end, lies directly on the front surface of the shank of the magnet yoke near the mounting part, wherewith a pivoting axis of the hinged armature is fixed by the fact that the corner edge of the front surface of the yoke side near the mounting part is beveled. This forms a tilting edge around which the hinged armature swings.

It is difficult in manufacturing technology to make this very slight bevel so accurately that the position of the pivoting axis of the hinged armature is well defined. This however would be desirable, since the distance between the pivoting axis of the hinged armature and the engagement point of the mounting part, and thus the length of the lever arm by way of which the mounting part engages on the hinged armature, is very small. A slight uncontrolled shift in the pivoting axis of the hinged armature brings about a change which is large percentagewise in the lever arm and thus also in the force which must be overcome by the magnet in attracting the hinged armature.

BRIEF STATEMENT OF THE INVENTION

The invention is based on the problem, for a hinged armature magnet of the type mentioned at the beginning, of supplying a support for the hinged armature which can be produced simply and at low cost and in which the position of the pivoting axis of the hinged armature can be accurately maintained.

This problem is solved according to the invention by having the hinged armature, near its fixed end, and the mounting part rest in common against a substantially cylindrical pin which is arranged with its cylindrical axis substantially parallel to the pivoting axis of the hinged armature in the region of the corner edge of the magnet yoke which is near this pivoting axis.

A cylindrical pin can be fabricated, from steel for example, in a simple manner at low fabrication costs and with high precision. Since both the hinged armature and the mounting part rest in common against the same pin, the length of the lever arm between the point of engagement of the mounting part and the bearing line of the hinged armature on the pin is accurately defined. In the swinging motion of the hinged armature this length varies in an accurately defined manner such that the lever arm between the point of engagement of the mounting part and the bearing line of the hinged armature on the pin, and thus the torque to be overcome by the magnetic force, is smaller in the opened position of the hinged armature than in its closed position in which it is retained on the magnet yoke by the magnetic force. This has the advantage that when the hinged armature magnet is switched on, by reason of the short range of its magnetic force the armature is not exposed to the latter in its full degree, and also this exerts only a relatively small restoring force on the hinged armature, while conversely when the hinged armature magnet is switched off, a relatively high restoring force acts on the hinged armature magnet, which at the moment of switching off is exposed to the full action of the magnetic force. This change in the restoring force between the open position and the closed position of the hinged armature, which is possible through the supporting of the hinged armature according to the invention, makes possible a higher operating frequency and/or a more precise operation at a higher frequency as compared with conventional hinged armature magnets.

This effect is intensified still further in that by the use of a cylindrical pin for the supporting of the hinged armature the friction is reduced in the swinging motion of the hinged armature, especially if the surface of the pin is polished or otherwise made smooth.

With a U-shaped magnet yoke, it is advantageous for the mounting part to be constructed on one shank of a U-shaped spring bracket at least partly enveloping the magnet yoke, the other shank of which carries a guide piece, enveloping the stop, for the free end of the hinged armature, wherewith the shanks of the U-shaped spring bracket are movable flexible with respect to the magnet yoke. Obviously other spring means may also be provided which will exert the required restoring force on the mounting part.

In the ideal case, the front surface of the yoke shank turned toward the hinged armature forms a tangential plane to the pin. Since however, this presupposes a high manufacturing accuracy, it is suitable for the pin to be arranged in a cutout of the yoke shank in such a way that its surface projects out slightly over the surface of the yoke shank turned toward the hinged armature and that toward the mounting part. This insures that the hinged armature and the mounting part respectively have a line contact with the pin. However, the distance by which the pin surface projects out over the front surface of the yoke shank turned toward the hinged armature should be small enough that the hinged armature in its attracted position lies substantially flat on the front surface of the yoke shank.

In order to fix the pin in the cutout in its axial direction, the pin advantageously shows on its surface a recess intended to engage with the cutout in the yoke shank, the axial extent of which recess is substantially the same as the width of yoke shank measured in the axial direction.

The mounting of the pin on the magnet yoke is considerably simplified if the mounting part is prestressed in the direction of the yoke shank adjacent to it. In this way the mounting part rests against the pin surface under initial spring tension and retains the pin firmly in the cutout of the yoke shank. With the arrangement of the mounting part on a U-shank of the U-shaped spring bracket, the formerly necessary guiding of the U-shank of the spring bracket in grooves, which were formed parallel to the longitudinal direction of the yoke shank adjacent to the U-shank, is also eliminated thereby.

Further advantages and features of the invention will be seen from the following description, which in combination with the attached figures will explain the invention on the basis of an embodiment example.

DETAILED DESCRIPTION OF THE PREFERRED EMBODIMENT

Figure 1:
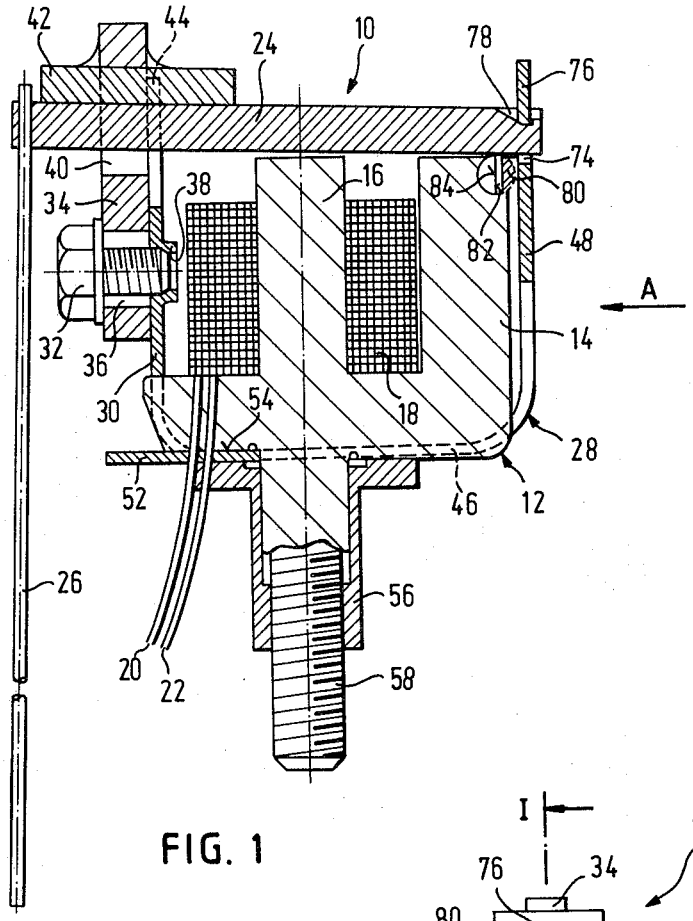
FIG. 1 shows a longitudinal section through the hinged armature magnet according to the invention along lines I—I in FIG. 2 in an enlarged scale.
Figure 3:
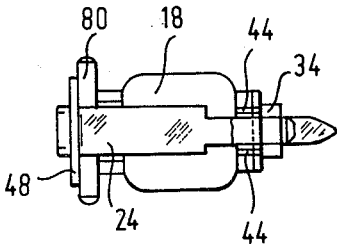
FIG. 3 shows a top plan view of the hinged armature magnet represented in FIGS. 1 and 2.
Figure 2:
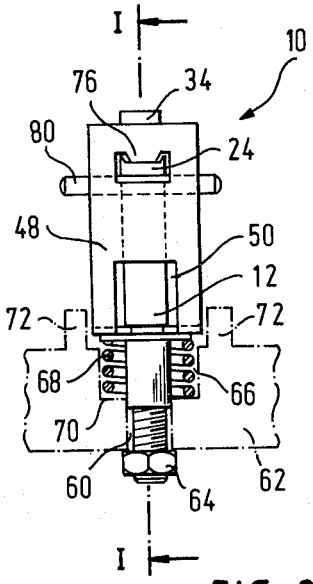
FIG. 2 shows a view of the hinged armature magent in the direction of the arrow A in FIG. 1, in which the hinged armature magnet is mounted on a printer head carrier, represented by way of suggestion, of a matrix printer head.

The hinged armature magnet represented in FIGS. 1 to 3 and represented in general as 10 essentially includes a U-shaped magnet yoke 12 consisting of sintered metal and with two yoke shanks 14 and 16, of which the yoke shank designated as 16 carries a magnetic coil 18 with lines 20, 22 a hinged armature 24 consisting of sintered metal, which on one free end carries a printing needle 26, a U-shaped spring bracket 28 encircling the magnet yoke 12, and finally a guide piece 34 consisting of shock-absorbing plastic and fastened on a free flexible first U-arm 30 of the spring bracket 28 by means of a bolt 32. The bolt 32 in this case engages in a threaded bore 38 of the first U-arm 30 of the spring bracket 28, by way of an oblong hole 36 formed in the guide piece. By reason of the oblong hole 36, the guide piece 34 may be moved parallel to the first U-arm 30 and be locked in its momentary position by the screw 32. The guide piece 34 has in its upper part a perforation 40 through which the hinged armature 24 protrudes by its free end, wherewith a stop part 42, which likewise consists of plastic and is for example, cemented to the guide part 34, and serves as a stroke limiting device for the hinged armature 24, is inserted into the upper part of the perforation. The first U-shank 30 of the spring bracket 28 is constructed in fork shape on its free end (FIGS. 1 and 3), where the hinged armature 24 strikes through between the fork ends 44.

The guide pieces 34, due to its elastically flexible mounting on the spring bracket 28, ensures a very good recoil damping for the hinged armature 24 and makes it possible to adjust the stroke of the hinged armature 24.

The spring bracket 28 includes a longitudinal slot 50 (FIG. 2) in the region of its transverse U-shank and respectively in an adjacent part of the first U-shank 30 and of the second U-shank 48, which slot is interrupted by a narrow arm 52 (FIG. 1) only in the region of the transverse U-shank 46. The magnet yoke 12 shows a step 54 on its side away from the hinged armature 24, in which step the arm 52 engages in such a way that its outer surface mates with the outer surface of the magnet yoke 12. For this the magnet yoke 12 engages in the slot 50 in the manner represented in FIG. 1. The spring bracket 28 is retained on the magnet yoke 12 by a nut 56 which is screwed onto a threaded pin 58 which is constructed integral with the magnet yoke 12 and extends in an opposite direction from the central yoke shank 16. By the lower end of this threaded pin 58 the whole hinged armature magnet 10 can be inserted in a bore 60 of a printer head carrier 62 and can be locked with a nut 64. The bore 60 shows one segment 66 which has a larger diameter and is close to the hinged armature magnet 10, in which segment a pressure spring 68 is arranged which is supported on the one hand on a shoulder 70 of the bore 60, 66 and on the other hand on the nut 56 or the underside of the hinged armature magent 10. By means of this pressure spring the hinged armature magnet 10 is adjustable in height with respect to the printer head 62. The hinged armature magnet 10 is secured against rotating with respect to the printer head carrier 62 by lateral stops 72 on the surface of the printer head carrier 62.

The mounting part of the second U-shank 48 of the spring bracket 28 has a perforation 74 near its free end through which the hinged armature 24 protrudes by its end away from the printing needle 26. A supporting tongue 76 of the U-shank 48 protrudes into the perforation 74, which tongue engages in a recess 78 on the hinged armature 24 under spring loading, and thereby the end of the hinged armature 24 presses against a cylindrical hinge pin 80 which is inserted in a step-shaped recess 82 on the upper corner edge of the yoke shank 14 turned toward the U-shank 48. For this purpose the bearing pin 80 shows a cutout or indentation 84 (FIG. 1), the axial dimension of which equals the thickness of the magnet yoke 12, so that the bearing pin 80 is fixed tightly, and is incapable of shifting axially, on the magnet yoke 12.

The bearing pin 80 by its surface projects out slightly over the surface of the magnet yoke 12 which is turned toward the U-shank 48 of the spring bracket 28 and over the front surface of the yoke shank 14, which is turned toward the hinged armature 24, so that a line contact between the bearing pin 80 and the U-shank 48 or the hinged armature 24 is ensured. The overhang of the bearing pin 80 over the front surface turned toward the hinged armature 24 is then so small that the air gap between the front surface of the yoke shank 14 and the hinged armature 24 is negligible for the magnetic flux. The U-shank 48 is under initial stress in the direction of the magnetic yoke 12, so that it is under this initial stress as it lies against the bearing pin 80.

When the hinged armature magnet 10 is actuated, the hinged armature magnet 24 rolls on the surface of the bearing pin 80, and this accurately defines the distance between the line of contact of the hinged armature 24 with the surface of the bearing pin 80 and the support formed by the supporting tongue 76 in any position of the hinged armature 24. This means that the length of the lever arm on which the U-shank 48 of the spring bracket 28 acts is likewise accurately defined. In this way, the restoring torque with which the spring bracket 28 acts on the hinged armature 24, and which must be overcome by the magnet in order to swing out the hinged armature 24, is accurately fixed in any position of the hinged armature 24. The restoring element is shorter in the opened position of the hinged armature 24, because of the then shorter lever arm, than in the closed position of the hinged armature 24.

Since the bearing pins 80 can be fabricated in a simple and economical manner with great precision, hinged armature magnets can now be produced without great cost, in which the fabrication precision formerly customary in the region of the bearing support of the hinged armature 24 becomes practically negligible.

When the magnet coil 18 is energized, then a magnetic flux is generated in the magnet yoke 12 which is closed by way of the hinged armature 24. The hinged armature 24 is thereby pulled from the position represented in FIG. 1 against the magnet yoke 12. Through the tilting of the hinged armature 24 around the bearing pin 80, the spring bracket 28 is put under tensile stress which is opposed by a spring force which arises particularly from the bowed sections of the spring bracket 28 which are delimited by the slot 50, which sections according to FIG. 2, are spaced apart from the magnet yoke 12 and thus can execute a spring motion with respect to the lower horizontal part of the spring bracket 28. Thereby the spring bracket 28 is slightly shifted sideways in its longitudinal direction on the magnet yoke 12. When the current supply is switched off, a restoring motion occurs on the bowed sections of the spring bracket 28, whereby a tensile force in a downward direction acts on the hinged armature 24 and swings the latter upward again around the bearing pin 80 until it strikes against the stop piece 42 of the guide piece 34. Since the spring bracket 28 practically rests against the magnet yoke only by its arm 52, a very good damping of the spring bracket 28 results. The very short length of the lever arm on which the U-shank 48 of the spring bracket 28 acts makes possible a relatively large stroke motion of the hinged armature 24 for an extremely slight spring deflection.

What is claimed is:

1. A hinged armature magnet for moving a device such as a printing needle between first and second positions comprising:

a magnetic yoke (12) having a first arm (16) carrying a coil (18) for providing a motive force, said yoke (12) having a second arm (14) adjacent to but spaced from the first arm (16) and magnetically integral therewith;

a bearing pin (80) non-rotatably mounted on the second arm (14) near an extremity thereof;

a bracket spring (28) secured to the yoke (12) and having a U-shank (48) with a mounting part which extends adjacent to but is spaced from the pin (80);

an armature (24) having a first relatively fixed end secured to the mounting part of the U-shank (48) near the pin (80) and bearing against the pin (80) and extending over but normally being spaced from the arms (14, 16) of the yoke (12), the armature (24) having a second relatively free end remote from the first end and adapted to carry said device;

whereby energization of the coil (18) causes the armature (24) to be drawn toward and into contact with the arm (16) and to roll over the pin (80) against the spring force of the U-shank (48);

and stop means (42) for delimiting the return movement of the armature (24) away from the arm (16) when the coil (18) is de-energized.

2. A hinged armature magnet as claimed in claim 1, characterized in that with a U-shaped magnet yoke (12), the mounting part is constructed on one shank of a U-shaped spring bracket (28) which at least partly envelops the magnet yoke (12), the other shank of which bracket carries a guide piece (34), enveloping the stop, for the free end of the hinged armature (24), wherein the shanks of the spring bracket (28) are flexibly movable with respect to the magnet yoke (12).

3. Hinged armature magnet as claimed in claim 1, characterized in that the pin (80) is arranged in a cutout (82) of the yoke shank (14) in such a way that its surface projects out slightly over the surface of the magnet yoke (12) turned toward the hinged armature (24) and that turned toward the mounting part, respectively.

4. Hinged armature magnet as claimed in claim 3, characterized in that the pin (80) shows on its surface a recess (84) intended for engagement with the cutout (82) in the magnet yoke (12), the axial extent of which recess is substantially the same as the width of the magnet yoke (12) measured in the axial direction.

5. Hinged armature magnet as claimed in claim 1, characterized in that the mounting part is prestressed in the direction toward the yoke shank (14) adjacent to it.

* * * * *